US005236184A

United States Patent [19]

Cattini

[11] Patent Number: 5,236,184

[45] Date of Patent: Aug. 17, 1993

[54] AUTOMATIC SPREADER FOR KNITTED FABRICS WITH AN ENLARGING CALENDER

[75] Inventor: Flavio Cattini, Bergamo, Italy

[73] Assignee: FK Arna S.r.l., Bergamo, Italy

[21] Appl. No.: 828,158

[22] Filed: Jan. 30, 1992

[30] Foreign Application Priority Data

Apr. 3, 1991 [IT] Italy ..... 000032/91[U]

[51] Int. Cl.[5] ..... B65H 29/46

[52] U.S. Cl. ..... 270/31

[58] Field of Search ..... 270/31; 26/53, 72, 87, 26/99, 100

[56] References Cited

U.S. PATENT DOCUMENTS

| | | | |
|---|---|---|---|
| 1,325,224 | 12/1919 | Wunsch | 270/31 |
| 1,866,088 | 7/1932 | Cutter | 270/31 |
| 2,358,188 | 9/1944 | Scoles et al. | 270/31 |
| 2,659,597 | 11/1953 | Shaak et al. | 270/31 |
| 3,645,524 | 2/1972 | Grimm et al. | 270/31 |
| 4,262,893 | 4/1981 | Sgroi | 270/31 |

*Primary Examiner*—Edward K. Look
*Assistant Examiner*—John Ryznic
*Attorney, Agent, or Firm*—McGlew and Tuttle

[57] ABSTRACT

The invention relates to an automatic spreader for knitted fabrics with an enlargening calender having a spreading table and a spreading carriage alternatively movable on said table and in which said spreading carriage (11) has an opening (13) in the middle which is transversal to the table, the sides of said opening having horizontal guides (14) transversal to the direction of the spreading of the fabric on the table and said guides having a frame (15) which is movable on it and carrying support means for the fabric to be spread and at least a pair of enlargening calender rollers (19).

4 Claims, 2 Drawing Sheets

AUTOMATIC SPREADER FOR KNITTED FABRICS WITH AN ENLARGING CALENDER

FIELD OF THE INVENTION

The present invention regards equipment for the spreading of fabrics which are on a roll or folded in layers onto a table. More precisely it regards an automatic spreader for knitted fabrics with an enlargening calender.

BACKGROUND OF THE INVENTION

Such an automatic spreader generally has a mobile carriage on a table and carrying the knitted fabric on a roll or folded in layers to be spread, and at least a pair of rollers working as calenders placed on one side of the carriage and designed to enlarge the fabric before its spreading on the table. However, the arranging of the material directly on the carriage and its threading between rollers is not convenient to carry out. Furthermore, the position of the spreading means cannot be varied in that they only have one way of use.

SUMMARY AND OBJECTS OF THE INVENTION

The object of the present invention is to supply an automatic spreading group for knitted fabrics with two ways of use and having a more convenient loading and threading of the fabric obtained through a new arrangement and combination of the elements of the group.

Another aim of the invention is to supply an automatic spreading group in which the unlargening calender is not placed on one side, but in the middle of the mobile carriage and is supported by a frame carrying the fabric to be spread. Yet another object of the invention is to supply an automatic spreading group in which the frame carrying the fabric to be spread and supporting the enlargening calender is slidable and extractable from one side of the carriage in a transversal direction to the table so as to be convenient to get to and to facilitate the loading and threading of the fabric.

BRIEF DESCRIPTION OF THE DRAWINGS

The here proposed automatic spreader for knitted fabrics with an enlargening calender will be described in further detail with references being made to the attached drawings in which.

DETAILED DESCRIPTION OF THE PREFERRED EMBODIMENT

Figure 1:
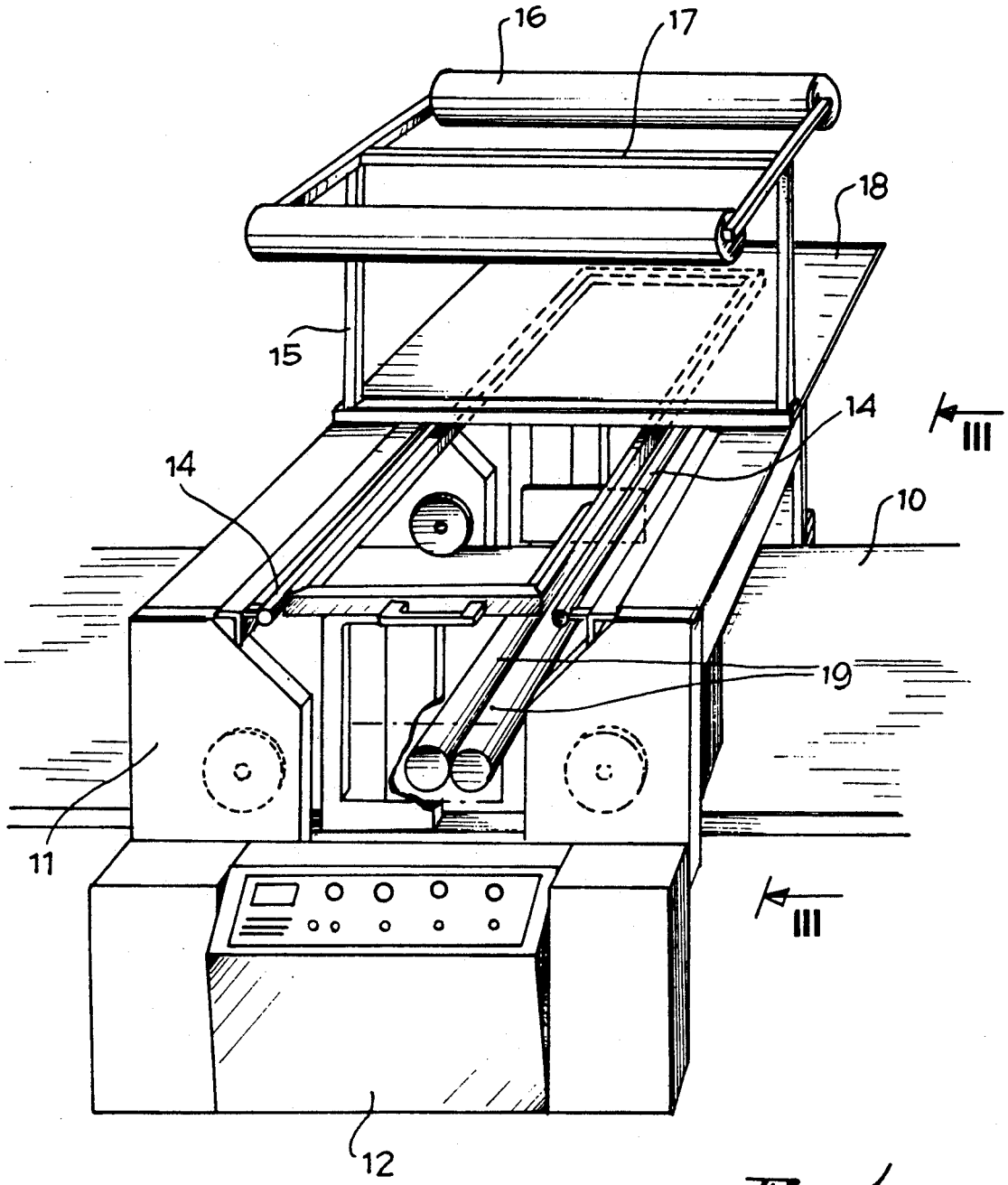
FIG. 1 is a perspective view of an automatic spreader with an enlargening calender.
Figure 2:
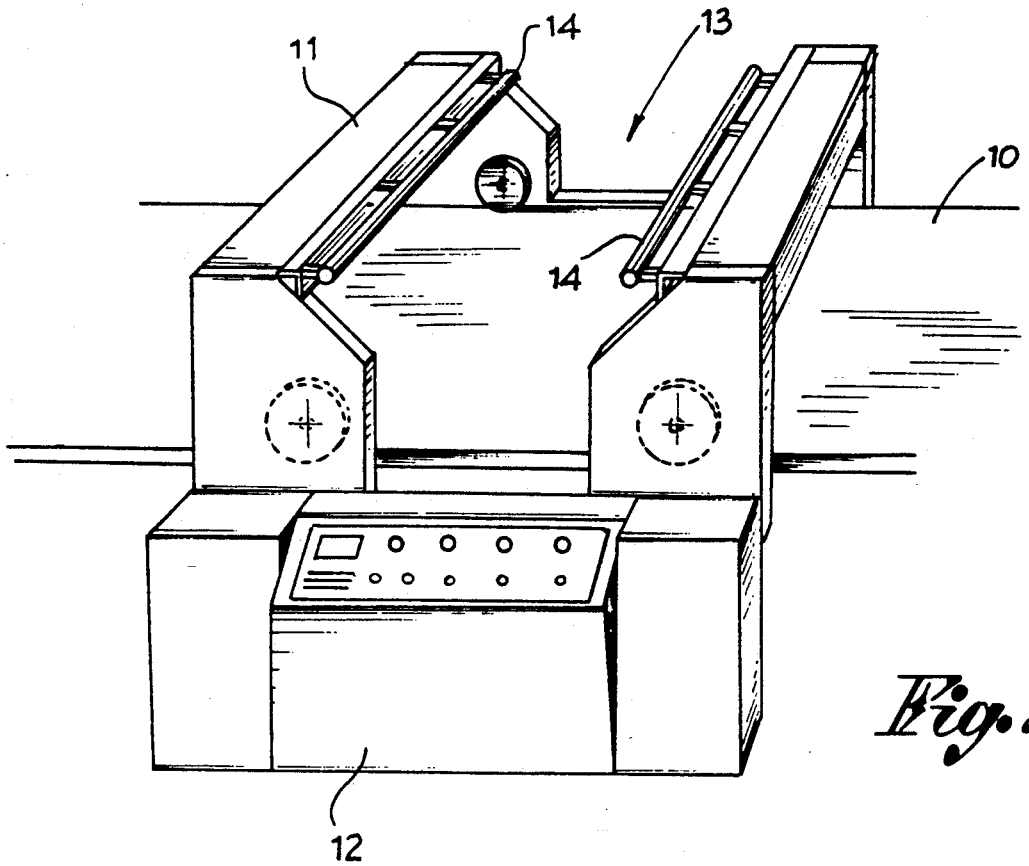
FIG. 2 is a perspective view of the carriage of the automatic spreader.
Figure 3:
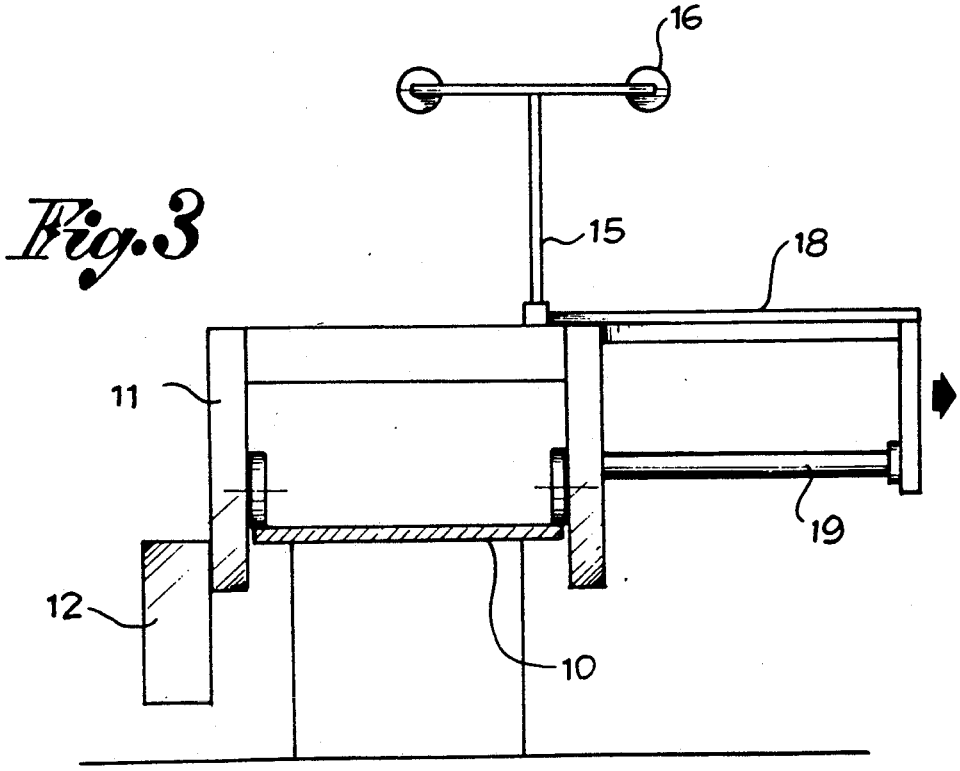
FIG. 3 is a view taken in the direction of the arrows III-III in FIG. 1 with a fabric carrying frame and enlargening calender moved outwards.

In said drawing a table for the spreading of fabric (10), especially knitted fabrics, has a spreading carriage (11) which moves in an alternative and known way on the table. Said spreading carriage (11) is equiped with necessary control means (12).

In accordance with the invention, the carriage (11) has an opening (13) in the middle which is transverse to the table and has horizontal guides (14) on the opposite sides of said opening, the guides thus being transverse to the direction of the spreading of the fabric.

A frame (15) is fitted on the carriage (11) for supporting the fabric and is assembled and slidable in the guides (14). Above the slide guides (14) the frame (15) has at least one shaft (16), one transmission rod (17) and one table (18) at a different height. The shaft (16) is designed to hold a roll of fabric to be spread when the fabric is wrapped round the roll. In a similar way, the table 18 holds the fabric to be spread when the fabric is folded in layers.

In both cases the fabric is sent by the rod (17) towards a couple of enlarging rollers (19).

In accordance with the invention, these two rollers (19) are assembled on said frame (15) in the opening (13) of the spreading carriage (11) below the guides (14), next to the table and positioned transversally to the table. The calender rollers (19) enlarge the fabric coming from the roll or folded in layers and place it on the table.

The frame (15) which carries the support means of the fabric and the calender rollers through the slide guides (14) is movable and extractable towards one side of the table so as to facilitate maintenance and the loading of the fabric to be spread and to improve access to the rollers for the threading operation. Furthermore, the part of the frame having the shaft or roll carrier shafts and the table for fabric folded in layers can be rotated at 90° so that the roll holder can be positioned parallelly or transversally to the longitudinal axis of the table for two ways of spreading the fabric.

I claim:

1. An automatic spreader for knitted fabrics, comprising: a spreader table extending longitudinally for providing a longitudinal direction of spreading; a spreading carriage alternatively movable on said table in said direction of spreading; an opening formed in said spreading carriage in a middle of said spreading carriage, said opening extending transverse to said direction of spreading; horizontal guides including a guide positioned on each side of said opening, said horizontal guides extending transverse to said direction of spreading; a frame assembly including a frame structure moveable on said horizontal guides; a fabric support means for supporting fabric to be spread, said fabric support means being connected to said frame structure; a cooperating pair of enlarging calendar rollers positioned within said opening of said spreader carriage, and connected to said frame, said enlargening calendar rollers extending transverse to said direction of spreading, said frame and connected support means and calendar roller pair being moveable on said guides.

2. An automatic spreader according to claim 1, wherein said frame is extractable from one side of said spreading carriage upon moving said spreading carriage on said guides, transversally to said direction of spreading.

3. An automatic spreader according to claim 1, further comprising: a fabric table connected to said frame, said support means including a shaft supported by said frame, a rod being connected to said frame to facilitate moving the fabric toward said calendar rollers.

4. An automatic spreader for knitted fabrics, comprising: a spreader table extending longitudinally for providing a longitudinal direction of spreading; a spreading carriage alternatively movable on said table in said direction of spreading; an opening formed in said spreading carriage in a middle of said spreading carriage, said opening extending transverse to said direction of spreading; horizontal guides including a guide positioned on each side of said opening, said horizontal guides extending transverse to said spreading direction; a frame assembly including a frame structure moveable on said horizontal guides; a fabric support means for supporting fabric to be spread, said fabric support means being connected to said frame structure; a cooperating pair of enlarging calendar rollers positioned within said opening of said spreader carriage, and connected to said frame, a fabric table connected to said frame, said support means including a shaft supported by said frame, said enlarging calendar rollers extending transverse to said direction of spreading, said frame and connected support means and calendar roller pair being moveable on said guides.

* * * * *